US006264772B1

(12) United States Patent
Drakin

(10) Patent No.: US 6,264,772 B1
(45) Date of Patent: Jul. 24, 2001

(54) PYROTECHNICAL, AEROSOL-FORMING COMPOSITION FOR EXTINGUISHING FIRES AND PROCESS FOR ITS PREPARATION

(75) Inventor: Nikolay Vasiljevich Drakin, Moskovskaya oblast (RU)

(73) Assignee: R-Amtech International, Inc., Bellevue, WA (US)

( * ) Notice: Subject to any disclaimer, the term of this patent is extended or adjusted under 35 U.S.C. 154(b) by 0 days.

(21) Appl. No.: 09/294,716

(22) Filed: Apr. 20, 1999

(30) Foreign Application Priority Data

Jul. 30, 1998 (RU) ..... 98113952

(51) Int. Cl.[7] ..... C06B 45/10; C06B 45/02; D03D 23/00

(52) U.S. Cl. ..... 149/19.92; 149/19.1; 149/21; 149/109.6

(58) Field of Search ..... 149/21, 110, 61, 149/19.1, 19.92; 169/46, 47; 252/3, 5; 264/3.1, 3.4

(56) References Cited

U.S. PATENT DOCUMENTS 4,251,699 * 2/1981 Wiltgen, Jr. ..... 200/144
4,770,794 * 9/1988 Cundasawmy et al. ..... 252/3
5,056,602 * 10/1991 Tapscott et al. ..... 169/46
5,269,378 * 12/1993 Maas et al. ..... 169/48
5,425,426 * 6/1995 Baratov et al. ..... 169/46
5,441,114 * 8/1995 Spector et al. ..... 169/14
5,609,210 * 3/1997 Galbraith et al. ..... 169/26
5,831,209 * 11/1998 Kozyrev et al. ..... 149/21
5,865,257 * 11/1998 Kozyrev et al. ..... 169/46

FOREIGN PATENT DOCUMENTS 0561035 9/1993 (EP) .
9217244 10/1992 (WO) .

* cited by examiner

*Primary Examiner*—Charles T. Jordan
*Assistant Examiner*—Aileen J. Baker
(74) *Attorney, Agent, or Firm*—Rothwell, Figg, Ernst & Manbeck, p.c.

(57) ABSTRACT

The invention relates to fire-extinguishing technology, in particular a process for producing aerosol-forming pyrotechnical compositions for extinguishing fires. The process includes the steps of mixing powdery combustible binder, oxidizing agent and dicyandiamide. The combustible binder is a polycondensate of formaldehyde and a organic compound, of a fraction from 70 to 120 $\mu$m. The oxidizing agent is an alkali nitrate of a fraction from 15 to 25 $\mu$m. The dicyandiamide is a fraction from 40 to 80 $\mu$m. Subsequently, there is added to the above, respective fractions of the combustible binder of 10 to 25 $\mu$m of the oxidizing agent of 1 to 7 $\mu$m and of the dicyandiamide of 7 to 15 $\mu$m. The weight ratios of the fractions of combustible binder, oxidizing agent and dicyandiamide are 70:30, 25:75 and 80:20. The resulting mixture is molded while the content of the components is 9 to 20 weight percent dicyandiamide, 6 to 14 weight percent combustible binder, and the balance weight percent oxidizing agent.

10 Claims, No Drawings

PYROTECHNICAL, AEROSOL-FORMING COMPOSITION FOR EXTINGUISHING FIRES AND PROCESS FOR ITS PREPARATION

FIELD OF THE INVENTION

The invention relates to fire-prevention, in particular to fire-extinguishing agents containing pyrotechnical compositions, which generate a fire-extinguishing aerosol formed as a result of the thermal decomposition of said compositions at combustion.

Aerosol-forming compositions are used in fire-extinguishing systems for fires in enclosed and half-enclosed spaces, and namely in:

warehouses and garages;

office and factory rooms;

sections of transport media such as land vehicles, ocean-going and river ships, aeroplanes;

air-ventilator systems, etc.

DESCRIPTION OF THE BACKGROUND ART

Fire-extinguishing compositions must meet a whole complex of requirements:

a high fire-extinguishing efficiency;

a low toxicity of the combustion products;

a low temperature of the combustion products;

a simple, safe and low energy consuming preparation technology;

durability of the composition.

The maintenance of all the requirements interferes with the problems concerning the reciprocal, often conflicting with one another, effects of the factors related to the technology of preparation of fire-extinguishing compositions and their characteristics. For example, the requirement of high fire-extinguishing efficiency makes it necessary to use a large amount of solid fillers (oxidizing agents, combustible agents) in the compositions. However, the increase of the portion of solid fillers leads to an increased molding pressure, which in turn increases the hazardness of the process and its energy capacity. The high molding pressure leads due to the increased surface friction between the particles of the solid fillers to the appearance of stress at the contact point of the particles, the formation of pores and, consequently, to a decrease of the stability and also to a non-uniform distribution of the particles in the molded composition, which leads to its non-uniform combustion and, as a consequence, to a decrease of the fire-extinguishing efficiency.

For the development of novel compositions and the improvement of known compositions, the problem is said to meet the sum of present requirements or to significantly improve separate properties and characteristics.

A composition for extinguishing fires is known (RU 2001647), which contains as combustible binder an epoxide resin in an amount of 10–14.5% by weight, an isomethyltetrahydrophthalic anhydride curing agent in an amount of 12–15% by weight, potassium perchlorate in an amount of 2–25% by weight as oxidizing agent, as additives carbon or a pigment in an amount of 0.001–0.5% by weight, sulforicinate in an amount of 0.01–0.5% by weight, and potassium nitrate the balance. When said composition is used, the fire-extinguishing concentration amounts to 23–27 g/m$^3$.

A composition for extinguishing fires is known (RU 2001648), which contains an epoxide resin in an amount of 1.5–15% by weight as combustible binder, isomethyltetrahydrophthalic anhydride in an amount of 1.5–15% by weight as curing agent, and additionally a polyether (polyester) resin in an amount of 7.5–30% by weight, methylethylketone peroxide in an amount of approximately 0.075% by weight, potassium perchlorate in an amount of 10–40% by weight as oxidizing agent, as additives sulforicinate or carbon in an amount of 0.001–0.5% by weight, and potassium nitrate the balance. The composition possesses an increased impact resistance if it contains the epoxy resin in an amount of 1.5% by weight and the polyether (polyester) resin in an amount of not more than 30% by weight. There exists also a lower content limit for the polyether (polyester) resin, i.e. 7.5% by weight, but in this case the epoxy resin must be present in an amount of up to 15% by weight.

The process for the preparation of the compositions for extinguishing fires according to RU 2001647 and RU 2001648 comprises the steps of successive charging and mixing of the components of the composition. Said process comprises:

Charging of the binder and the curing agent (epoxy resin and isomethyltetrahydrophthalic anhydride, and according to RU 2001648 additionally the polyether (polyester) resin and methylethylketone peroxide) and mixing within 30 minutes at a temperature of 20° C. with evacuation.

Charging of two doses of alkali metal nitrate with mixing for 10 minutes.

Charging of two doses of alkali metal perchlorate with mixing for 10 minutes and subsequent mixing of the components for 1 hour.

Charging of carbon or sulforicinate and mixing of all components for 30 minutes, whereby the last 20 minutes are carried out with evacuation.

The final composition is poured into forms and cured for 7–10 days at 80° C.

As a result, an article of predetermined shape is obtained, which may be used for extinguishing fires by means of its ignition by an initiating system.

Said compositions and the process for their preparation possess a series of essential disadvantages:

a high-energy capacity of the process due to the use of the epoxy resin with isomethyltetrahydrophthalic anhydride, which requires a prolonged curing of the composition (7–10 days at 80° C.). The use of polyethylene polyamine as curing agent allows to significantly (up to 1 hour) reduce the curing time, but at the same time there occurs an increase of the dynamic viscosity with such a velocity that it is not possible to prepare the composition at an industrial scale due to the loss of "survivability" at the stage of processing;

ecological hazardness due to the presence of uncured epoxy resin and isomethyltetrahydrophthalic anhydride in the composition, which may cause dermatitis and ulcers, if said components come in contact with the skin;

limited possibility to prepare compositions with a large content of solid phases (oxidizing agent, gas-aerosol-forming agent), because the reduction of the content of the binder leads to a drastic increase of the viscosity and the lack of flowability of the composition, furthermore, leads to difficulties in homogeneously dispersing the components and to an increase of the hazardness of the steps of mixing and molding articles from said composition. The use of high-weight portions of the binder in the composition leads to a low stability of the ignition and combustion of the composition, and also to a decrease of its fire-extinguishing efficiency;

the necessity to take additional steps in order to ensure the safeness during the processing of the composition for the case that methylethyleketone peroxide, which appears to be an explosive substance, is used in the composition. Furthermore, the provision of a stable composition is only possible in a narrow range of the proportion of epoxy resin and polyether (polyester) resin and correspondingly their curing agents, which affords very high demands on the accuracy of the dosing of the components and the necessity to observe a strict succession of the addition of the components;

a high dependence of the technological parameters (viscosity, flowability) of the composition and its fire-extinguishing concentration on minor changes in the preparation conditions and the concentration of the components. Thus, a change of the carbon content in the composition from 0.6 to 0.45% by weight leads to an increase of the viscosity by a factor of $10^3$ (from $2\times10^3$ poise to $8\times10^6$ poise) and a decrease of the flowability coefficient (from 0.8 to 0.05), whereas the fire-extinguishing concentration increases from 24 to 27 g/m$^3$.

Pyrotechnical compositions for use in a process for extinguishing voluminous fires are known (EP 0561035 B1). The first composition contains potassium perchlorate in an amount of 40–50% by weight, epoxy resin in an amount of 9–12% by weight, potassium chloride in an amount of 10–44% by weight, and magnesium powder in an amount of up to 4% by weight. A second composition contains potassium nitrate in an amount of 70–80% by weight, epoxy resin in an amount of 19–23% by weight and magnesium or aluminium powder in an amount of 2–4% by weight.

Said pyrotechnical compositions possess several essential disadvantages:

A high temperature of the combustion products;

harmful effect on living organisms of chlorine derivatives, which are present in the combustion products, and base (KOH), which, moreover, condensates on the surface of high-precision devices and similar equipments and may lead to corrosion;

harmful effect on living organisms of solid aerosol particles with a size of up to 1 μm, which irritate the mucous membrane of respiratory tracts, penetrate into blood vessels and practically do not move out of the organism.

A composition for extinguishing fire and a process for its preparation are known (WO 92/17244) which contains alkali metal nitrate and/or perchlorate in an amount of 55–90% by weight, a combustible binder in an amount of 10–45% by weight, such as iditol or a ballistic propellant. Additionally, the composition may contain a combustible binder in an amount of 1–42% by weight, for example, dicyandiamide, and also ammonium perchlorate in an amount of 5–32% by weight as additional oxidizing agent.

The process for preparing the composition is characterized in that the starting components ($KNO_3$, iditol, dicyandiamide) are prepared by grinding large agglomerates of particles and subsequent mixing of the powdery substances in a predetermined proportion. The prepared mixture is subjected to a blind pressing step and afterwards may be used as fire-extinguishing agent.

Said composition and process for its preparation possess several essential disadvantages:

a low gas-aerosol-formation velocity due to a low linear combustion velocity of the composition (approximately 1.5 mm/s);

a low fire and explosion safety and high energy capacity of the preparation process due to a high specific pressing pressure (approximately 2,000 kgf/cm$^2$);

a high combustion temperature of the composition (approximately 1,000° C.);

unstable conditions of the ignition and combustion of the composition due to a difference in vertical density and due to different stability properties in the total composition.

The pyrotechnical aerosol-forming composition for extinguishing fires and the process for its preparation as disclosed in RU 2101054 represents the closest prior art for the present invention. The composition contains as oxidizing agent potassium nitrate in an amount of 67–72% by weight, as combustible binder phenolformaldehyde resin in an amount of 8–12% by weight and as gas-aerosol-forming agent dicyandiamide representing the balance. The composition additionally may contain potassium bicarbonate or potassium benzoate or potassium hexacyanoferrate in an amount of 4–12% by weight.

The process for the preparation of said pyrotechnical compositions comprises the step of mixing potassium nitrate with a specific surface area of its particles of no less than 1,500 cm$^2$/g and the combustible binder being a phenolformaldehyde resin in admixture with ethanol and acetone in a ratio of 30–50:70–50. Afterwards, the solution is mixed with powdery potassium nitrate and the gas-aerosol-forming agent until a uniform distribution is achieved. Subsequently, the mixture is dried and granulated with simultaneously drying at a temperature of 20–70° C. until a residual content of moisture and volatile constituents of not more than 1% is present. The composition prepared according to such a process may be molded by means of blind pressing and used as a fire-extinguishing agent.

This composition and process for its preparation possess several essential disadvantages:

a high specific pressing pressure (approximately 1,400 kgf/cm$^2$) due to a high surface friction between the solid particles of the fillers;

a low combustion velocity of the composition (approximately 2.4 mm/s);

a high combustion temperature of the composition (approximately 900° C.);

a non-uniform distribution of special additives present in low amounts (combustion catalysts, technological additives), which leads to insufficiently effective utilization of said additives at the stage of preparing the composition and at its combustion;

harmful effects on living organisms and high weight portions of aerosol particles with a size of less than 1 μm (approximately 27% by weight), which penetrate through the mucous membrane into the blood vessels and practically do not move out of the organism and result in the formation of thrombi with a subsequent negative effect on life of the organism.

SUMMARY OF THE INVENTION

The technical problems which are solved by the present invention are the following:

reduction of the specific molding pressure and reduction of the hazardness and energy capacity of the process for the preparation of the composition;

increase of the combustion velocity of the composition and correspondingly increasing the velocity of the gas-aerosol-formation;

reduction of the combustion temperature of the composition;

increase of the uniformity of the distribution of the additives present in small concentrations and increase of their efficiency;

increase of the weight portion of the aerosol particles with a size of 1–2 μm due to a reduction of the portion of the particles with a size less than 1 μm and consequently increase of the ecological purity of the pyrotechnical composition.

These technical problems were solved by a pyrotechnical gas-aerosol-forming composition for extinguishing fires, which contains dicyandiamide as gas-aerosol-forming agent, which consists of particles of two fractions with 40–80 μm and 7–15 μm at a weight ratio of 80:20, potassium nitrate as oxidizing agent, which consists of particles of two fractions with 15–25 μm and 1–7 μm at a weight ratio of 25:75, a polycondensate of formaldehyde with organic compounds which are selected from the group consisting of phenol, melamine, carbamide as combustible binder, which consists of particles of two fractions with 70–120 μm and 10–25 μm at a weight ratio of 70:30, with the following content of the components in the mixture in % by weight:

| | |
|---|---|
| gas-aerosol-forming agent | 9–20 |
| Combustible binder | 6–14 |
| Oxidizing agent | balance. |

The composition may contain as additive, which controls the combustion velocity, potassium chromate or potassium dichromate, or ammonium dichromate in an amount of 1.0–3.5% by weight, which are applied from aqueous solutions onto the surface of the oxidizing agent of the fraction of 1–7 μm, and as additive for the reduction of the combustion temperature graphite in an amount of 0.2–0.5% by weight, which is applied onto the surface of the oxidizing agent of the fraction of 15–25 μm.

The solution of the above-mentioned technical problems concerning the present process for the preparation of pyrotechnical, gas-aerosol-forming compositions for extinguishing fires comprises the steps of mixing the powdery combustible binder, oxidizing agent and gas-aerosol-forming agent and subsequent molding, wherein at first the large sized fractions of the combustible binder with 70–120 μm, of the oxidizing agent with 15–25 μm and of the gas-aerosol-forming agent with 40–80 μm are mixed and subsequently their small-sized fractions with 10–25 μm, 1–7 μm and 7–15 μm are added to the obtained mixture.

If the process for preparing the aerosol-forming composition is carried out according to the embodiment, which comprises the steps of mixing a solution of the combustible binder, the oxidizing agent and the gas-aerosol-forming agent, subsequent drying, granulating with simultaneous drying and molding, then the mixing is carried out at first by combining the solution of the combustible binder with the large-sized fractions of the oxidizing agent and the gas-aerosol-forming agent, and afterwards, correspondingly their small-sized fractions are combined.

In this way a packing of the components' particles is formed, wherein the large particles form the framework, and the smaller particles fill into the intermediate space between them. In the process for the preparation of the composition between the solid particles, layers of the combustible binder are built up, which cover the solid particles and provide good conditions for the movement of the particles of the composition in the flow at the application of stress, which contributes to the reduction of the molding pressure, the reduction of hazardness, and also the reduction of the energy capacity at the preparation of the composition. Due to the effective packing of particles with different sizes, sites with stressed structure are practically absent in the composition, which leads to a high, long-lasting stability of the strength characteristics, which, in turn, leads to an equalizing of the velocity gradient when the composition is combusted in layers, and the realization of values of the total linear combustion velocity of the composition.

Due to the efficient packing of the components' particles it is possible to increase the weight portion of the particles of the oxidizing agent (up to 85% by weight), which leads to an increase of the weight portion of the solid aerosol phases, which form at the combustion of the composition. For the case that melamineformaldehyde or carbamideformaldehyde resins, which are prepared by polycondensation, are used in the composition as combustible binder, it is possible to increase the weight portion of the particles with 1–2 μm in the aerosol composition due to a reduction of the portion of the particles with less than 1 μm. This leads to an increase of the ecological purity of the fire-extinguishing aerosol. Hitherto, the use of such binders, which contain a huge amount of bound nitrogen, in pyrotechnical aerosol-forming compositions was not known. At the thermal decomposition of these binders, the portion of free inert gas, i.e. nitrogen, is increased and at the same time the portions of harmful, carbon-containing gases CO and $CO_2$ are reduced.

It was not possible to expect in advance or predict the obtained technical results, if the known methods for estimation of the optimal functions of particle size distribution were used for variants of different packings (V. V. Moshew, V. A. Ivanov, Reologicheskoye povedenye concentrirovannykh nonnewtonnovskykh suspensykh [Rheological Behavior of Concentrated Non-Newton Suspensions], M.: Nauka, 1990). In the present case, it was not possible to use said approaches, because they would have led to in advance incorrect results in the case of multi-component compositions and multi-functional, physico-chemical factors. In the composition three types of particles are used, which are different in their physico-chemical nature and show different effects on one another not only at the stage of preparation and processing of the composition but also when the composition is directly used for extinguishing a fire.

For further increasing the linear combustion velocity of the composition, it is necessary, prior to the mixing step, to apply potassium chromate or potassium dichromate or ammonium dichromate in an amount of 1.0–3.5% by weight from an aqueous solution onto the surface of the small-sized oxidizing agent fraction with 1–7 μm and to dry the treated oxidizing agent until constant weight. The application of the additives onto the surface is carried out by simply adding dropwise the solution under stirring to the oxidizing agent. The aqueous solution wets the oxidizing agent. When the moisture is removed the additive is retained on the surface due to physical thin film adsorption forces. The following steps of the preparation process are carried out as described above. At the ignition of the composition the heat front propagates within its volume and causes the thermal decomposition of the components including the oxidizing agent. The ions of chrome catalyze the decomposition of the oxidizing agent, which leads to an increased linear combustion velocity of the composition. Due to the fact that the chrome compounds are distributed on the surface and directly in the zone of the heated oxidizing agent, the efficiency of their catalytical effect increases.

A further possibility to influence the fire-extinguishing characteristics of the composition, namely the reduction of the combustion temperature of the composition, consists in the application of graphite in an amount of 0.2–0.5% by weight on the surface of the large-sized oxidizing agent fraction within 15–25 μm prior to the mixing step of their components. Graphite may be applied to the surface by mixing with the oxidizing agent, or at the stage of grinding or by sieving the oxidizing agent through a fractionating sieve.

Under small shearing forces graphite disintegrates and may easily be applied to the surface. The surface modification of the oxidizing agent with graphite gives the oxidizing agent and the whole composition hydrophobic properties and reduces the hygroscopicity of the latter, which is very important for achieving a long-lasting stability of the fire-extinguishing composition. At the same time, graphite as a lubricant reduces the surface friction of the solid particles, in particular the large-size particles, which build up the framework of the composition. As a result, the molding pressure, the explosion hazard and the energy capacity of the preparation process of the composition are reduced. However, the most important merit of graphite as additive is characterized in that it is located directly on the heated layer of the decomposed potassium nitrate and diffuses into the gas zone of the flame, where it interacts with the decomposition products of the gas-aerosol forming agent, the combustible binder, namely with $CO_2$ and $H_2O$, and enters into endothermic reactions under withdrawal of heat with these products:

| | |
|---|---|
| $C + 2H_2O \rightarrow CO_2 + 2H_2$ | −178, 15 kJ |
| $C + CO_2 \rightarrow 2CO$ | −172, 45 kJ |
| $C + H_2O \rightarrow CO + H_2$ | −175, 30 kJ |

This leads to a reduction of the temperature of the combustion products of the composition.

A comparative analysis of the present pyrotechnical gas-aerosol-forming agent for extinguishing fires and the present process for its preparation with the closest prior art documents revealed the following distinguishing features:

- Use of the oxidizing agent in the form of two fractions with 15–25 μm and 1–7 μm at a weight ratio of 25:75;
- Use of the gas-aerosol-forming agent in the form of two fractions with 40–80 μm and 7–15 μm at a weight ratio of 80:20;
- Use of the combustible binder in the form of two fractions with 70–120 μm and 10–25 μm at a weight ratio of 70:30;
- Use of a polycondensate of formaldehyde and melamine (2,4,6-triamino-1,3,5-triazine) or carbamide $(NH_2)_2CO$ (melamineformaldehyde and carbamideformaldehyde resins) as combustible binder;
- Use of chrome compounds applied to the surface of the oxidizing agent fraction with 1–7 μm in an amount of 1,0:3,5% by weight;
- Use of graphite applied to the surface of the oxidizing agent fraction with 15–25 μm;
- The step of mixing the components by successive dispersion of the oxidizing agent fraction with 15–25 μm and the gas-aerosol-forming agent fraction with 40–80 μm in the combustible binder and subsequent addition of their fractions with 1–7 μm and 7–15 μm to the obtained mixture.

DETAILED DESCRIPTION OF PREFERRED EMBODIMENTS OF THE INVENTION

Embodiment 1

For the preparation of 1 kg of the composition a blade mixer is charged with 77 g of a phenolformaldehyde resin fraction with 70–120 μm. Under stirring, 165 g of a potassium nitrate fraction with 15–25 μm are added, to the surface of which 5 g graphite have been previously applied. The application of graphite to the surface of the oxidizing agent is carried out by mixing them in a blade mixer and subsequently passing the modified oxidizing agent twice through a metal sieve with a mesh size of 40 μm.

Afterwards, 152 g of a dicyandiamide fraction with 40–80 μm are added, stirred for 5 minutes, and 495 g of a potassium nitrate fraction with 1–7 μm are added, to the surface of which potassium dichromate in an amount of 35 g have previously been applied.

The application of the dichromate to the potassium nitrate surface is carried out in a blade mixer by adding dropwise a 50% aqueous solution of potassium dichromate to the potassium nitrate under stirring, which is accomplished within 1 hour. Afterwards, the modified potassium nitrate is poured out on a tray and placed in a drying oven at a temperature of 80° C. for 2 hours until the weight portion of the moisture is less than 0.1%.

33 g of a phenolformaldehyde fraction with 10–25 μm are added under stirring to the obtained powdery mass, and afterwards 38 g of a dicyandiamide fraction with 7–15 μm are added and finally stirred for 15 minutes. The final composition is a powdery material of white color with a yellowish shade, which is molded by blind pressing. For the present composition, which corresponds to No. 3 of the Table, the specific pressing pressure is 1200 kgf/cm$^2$ (120 MPa).

Comparative characteristics of the present pyrotechnical aerosol-forming compositions and known compositions

TABLE

| Name of the Components of the Composition | Present Composition Content of the Components, % by wt. | | | | | 1) | 2) |
|---|---|---|---|---|---|---|---|
| Example No. | 1 | 2 | 3 | 4 | 5 | 6 | 7 |
| Potassium nitrate | 69.0 | 69.7 | 66.0 | 70.0 | — | 70 | 70 |
| Sodium nitrate | — | — | — | — | 70.0 | | |
| Dicyandiamide | 19 | 19 | 19 | 19 | 19 | 19 | 19 |
| Phenolformaldehyde resin | — | — | 11 | 11 | 11 | 11 | 11 |
| Melamineformaldehyde resin | 11 | — | — | — | — | — | — |
| Carbamideformaldehyde resin | — | 11 | — | — | — | — | — |
| Potassium dichromate applied onto the surface of small-sized potassium nitrate fraction | 1.0 | — | 3.5 | — | — | — | — |
| Graphite applied onto the surface of the potassium nitrate fraction | — | 0.3 | 0.5 | — | — | — | — |
| Designation of the characteristics of the composition | | | | | | | |
| Specific pressing pressure, kgf/cm$^2$ | 1000 | 980 | 1200 | 1000 | 990 | 1400 | 2000 |
| Linear combustion velocity, mm/s | 3.5 | 3.1 | 4.0 | 3.2 | 3.0 | 2.1 | 1.5 |
| Weight portion of the dispersed phase | 68 | 69 | 70 | 70 | 71 | 57 | 48 |

TABLE-continued

| | | | | | | | |
|---|---|---|---|---|---|---|---|
| of the aerosol, % | | | | | | | |
| Weight portion of the particles with 1–2 μm in the composition of the dispersed phase of the aerosol, % | 70 | 71 | 70 | 70 | 71 | 64 | 57 |
| Designation of the characteristics of the composition | Present Composition — | | | | | 1) | 2) |
| Example No. | 1 | 2 | 3 | 4 | 5 | 6 | 7 |
| Fire-extinguishing concentration, g/m$^3$ | 34 | 33 | 32 | 32 | 33 | 40 | 50 |
| Combustion temperature, ° C. | 640 | 620 | 650 | 720 | 750 | 890 | 950 |

1) Composition according to RU 2101054
2) Composition according to WO 92/17244

The pressing is carried out in one pressing step with a velocity of 0.003 m/s, wherein the pressure is maintained for 5 seconds until the end of the pressing.

Embodiment 2

For the preparation of 1 kg of the composition, a blade mixer is charged with 183.3 g of a 60% solution of phenolformaldehyde resin in ethanol. This amounts to 110 g when calculated on the basis of phenolformaldehyde resin.

The solution is prepared in a reactor equipped with a water-jacket for heating up to +50° C. and a stirrer rotating with a velocity of 85 rpm. The solution time is 1 hour. The prepared solution does not contain residual undissolved resin.

To the indicated amount of solution, 175 g of the potassium nitrate fraction with 15–25 μm are added as oxidizing agent, stirred for 5 minutes. Afterwards, 152 g of the dicyandiamide fraction with 40–80 μm are added as gas-aerosol-forming agent under stirring. After 5 minutes of stirring, 525 g of the potassium nitrate fraction with 1–7 μm are added and stirred for 10 minutes. Then 38 g of the dicyandiamide fraction with 7–15 μm are added and stirred for 10 minutes. Afterwards, the drying of the composition is carried out under rotating blades by ventilating it with air at room temperature and an excessive pressure of 1 kg/cm$^2$ for 15 minutes.

The prepared composition is placed in a granulator, supplied with calibrated outlet measures with a diameter of 1.2–2 mm. After passage through said measures, granulates of the composition are obtained which have a length up to 3 mm and a weight ratio of the components: dicyandiamide—19±0.5% by weight, potassium nitrate—70±0.5% by weight, and formaldehyde resin—11±0.5% by weight.

The obtained granules of the composition are placed on trays, which are placed in a drying oven at a temperature of +45° C. After drying, exactly for a period of 4 hours, the content of the residual volatile components does not exceed 0.8% by weight.

From the obtained dry granules of the composition, tablets are formed by the method of blind pressing. For the present composition, which corresponds to No. 4 of the Table, the specific pressing pressure is 1000 kgf/cm$^2$ (100 MPa). The pressing is carried out in one pressing step with a velocity of 0.003 m/s, wherein the pressure is maintained for 5 seconds until the end of the pressing. Examples Nos. 1 and 2 of the Table are prepared according to the procedure of embodiment 2. Examples Nos. 6 and 7 of the Table are prepared according to RU 2101054 and WO 92/17244, respectively.

The final composition is subjected to tests according to standard methods. Upon combustion the linear combustion velocity, the fire-extinguishing concentration, the combustion temperature, the weight portion of the disperse phase of the aerosol, the weight portion of the particles with 1–2 μm in the composition of the disperse phase of the aerosol are determined.

The obtained values are presented in the Table.

Industrial Use

The present composition for extinguishing fires and the process for its preparation allow to effectively extinguish fires of different burning materials in buildings and devices such as:

warehouses, garages, working places;

offices, places for keeping animals and birds;

motor and luggage sections of transport media;

ventilator systems of production plants, hotels, etc.

The advantages of the present composition and process for its preparation are the following:

ease and safety of the preparation process, durability and reliability during use, high fire-extinguishing efficiency, a broad base of raw materials for the components of the composition and the possibility to use easily available equipment for the performance of the preparation process, low pressure for molding an article from the composition, low combustion temperature, furthermore, the fire-extinguishing, gas-aerosol mixture does not show an injurious effect on human beings and living organisms surrounding them, the nature, and high-precision devices and systems.

What is claimed is:

1. A process for the preparation of a pyrotechnical, aerosol-forming composition for extinguishing fires, comprising the steps of mixing powdery combustible binder, which is a polycondensate of formaldehyde and an organic compound, of a fraction from 70 to 120 μm and an oxidizing agent, which is an alkali nitrate, of a fraction from 15 to 25 μm and dicyandiamide of a fraction from 40 to 80 μm, subsequently adding respective fractions of said ingredients of 10 to 25 μm, 1 to 7 μm and 7 to 15 μm, the weight ratios of the fractions of combustible binder, oxidizing agent and dicyandiamide being 70:30, 25:75 and 80:20, and molding the mixture while the content of the components is as follows, in % by weight:

dicyandiamide 9 to 20 combustible binder 6 to 14 oxidizing agent the balance.

2. A process for the preparation of a pyrotechnical, aerosol-forming composition for extinguishing fires, comprising the steps of dissolving in an organic solvent a 70 to 120 μm fraction and thereafter a 10 to 25 μm fraction of a combustible binder, which is a polycondensate of formaldehyde and an organic compound, dispersing in the obtained solution an oxidizing agent, which is an alkali nitrate, of a fraction from 15 to 25 μm and dicyandiamide of a fraction from 40 to 80 μm and subsequently respective fractions of said ingredients of from 1 to 7 μm and from 7 to 15 μm, the weight ratio of the fractions of dicyandiamide and the oxidizing agent being 80:20 and 25:75, respectively, drying, granulating with drying, and molding the mixture while the content of the components is as follows, in % by weight:

dicyandiamide 9 to 20 combustible 6 to 14 oxidizing agent the balance.

3. The process for preparing a pyrotechnical, aerosol forming composition according to claim 1 wherein the combustible binder is a polycondensate of formaldehyde and melamine or carbamide.

4. The process for preparing a pyrotechnical, aerosol forming composition according to claim 2, wherein the combustible binder is a polycondensate of formaldehyde and melamine or carbamide.

5. The process for preparing a pyrotechnical, aerosol-forming composition according to claim 1, wherein the combustible binder is polycondensate of formaldehyde and phenol.

6. The process for preparing a pyrotechnical, aerosol-forming composition according to claim 2, wherein the combustible binder is polycondensate of formaldehyde and phenol.

7. The process for preparing a pyrotechnical, aerosol-forming composition according to claim 1, wherein prior to the step of mixing, potassium chromate or potassium dichromate or ammonium dichromate is applied in an amount of 1.0 to 3.5% by weight from an aqueous solution onto the surface of the oxidizing agent of the fraction from 1 to 7 $\mu$m, and subsequently dried until constant weight is reached.

8. The process for preparing a pyrotechnical, aerosol-forming composition according to claim 2, wherein prior to the step of mixing, potassium chromate or potassium dichromate or ammonium dichromate is applied in an amount of 1.0 to 3.5% by weight from an aqueous solution onto the surface of the oxidizing agent of the fraction from 1 to 7 $\mu$m, and subsequently dried until constant weight is reached.

9. The process for preparing a pyrotechnical, aerosol-forming composition according to claim 1, wherein prior to the step of mixing, graphite is applied in an amount of 0.2 to 0.5% by weight onto the surface of the oxidizing agent of the fraction from 15 to 25 $\mu$m.

10. The process for preparing a pyrotechnical, aerosol-forming composition according to claim 2, wherein prior to the step of mixing, graphite is applied in an amount of 0.2 to 0.5% by weight onto the surface of the oxidizing agent of the fraction from 15 to 25 $\mu$m.

* * * * *